US010368172B2

(12) United States Patent
Ilkorur

(10) Patent No.: US 10,368,172 B2
(45) Date of Patent: Jul. 30, 2019

(54) DIAPHRAGM SUSPENSION FOR A LOUDSPEAKER

(71) Applicant: PSS BELGIUM N.V., Dendermonde (BE)

(72) Inventor: Onur Ilkorur, Dendermonde (BE)

(73) Assignee: PSS BELGIUM N.V., Dendermonde (BE)

( * ) Notice: Subject to any disclaimer, the term of this patent is extended or adjusted under 35 U.S.C. 154(b) by 0 days.

(21) Appl. No.: 15/760,376

(22) PCT Filed: Jul. 8, 2016

(86) PCT No.: PCT/EP2016/066356

§ 371 (c)(1),
(2) Date: Mar. 15, 2018

(87) PCT Pub. No.: WO2017/045795

PCT Pub. Date: Mar. 23, 2017

(65) Prior Publication Data

US 2019/0058953 A1 Feb. 21, 2019

(30) Foreign Application Priority Data

Sep. 15, 2015 (GB) ..... 1516297.7

(51) Int. Cl.
*H04R 7/00* (2006.01)
*H04R 7/20* (2006.01)
(Continued)

(52) U.S. Cl.
CPC ..... *H04R 7/20* (2013.01); *H04R 1/2834* (2013.01); *H04R 9/025* (2013.01); *H04R 9/06* (2013.01);
(Continued)

(58) Field of Classification Search
CPC ..... H04R 2307/207; H04R 2307/204; H04R 7/16; H04R 7/18; H04R 7/20
See application file for complete search history.

(56) References Cited

U.S. PATENT DOCUMENTS 4,056,697 A 11/1977 Heil
4,321,434 A * 3/1982 Irie ..... H04R 7/14 181/172
(Continued)

FOREIGN PATENT DOCUMENTS

EP 1515582 A1 3/2005
FR 2476423 A1 8/1981
(Continued)

OTHER PUBLICATIONS

UKIPO, Search Report for UK Patent Application No. 1516297.7, dated Nov. 10, 2015.
(Continued)

*Primary Examiner* — Matthew A Eason
(74) *Attorney, Agent, or Firm* — NK Patent Law

(57) ABSTRACT

A loudspeaker including a chassis, a drive unit and a diaphragm. The drive unit has a stationary part secured to the chassis and a translatable part secured to the diaphragm. An outer edge of the diaphragm is suspended from the chassis by an edge suspension. The edge suspension has a plurality of straight portions, each straight portion having a respective first surface and a respective second surface which meet along an edge to provide a spring which permits the diaphragm to be moved relative to the chassis by the drive unit. The edge suspension has at least one corner portion, wherein the/each corner portion joins two of the straight portions together and includes at least one geometrical interruption formed therein.

16 Claims, 11 Drawing Sheets

(51) Int. Cl.
*H04R 1/28* (2006.01)
*H04R 9/02* (2006.01)
*H04R 9/06* (2006.01)

(52) U.S. Cl.
CPC .... *H04R 2207/00* (2013.01); *H04R 2307/207* (2013.01); *H04R 2400/11* (2013.01)

(56) References Cited

U.S. PATENT DOCUMENTS

| | | | | |
|---|---|---|---|---|
| 6,385,327 | B1 | 5/2002 | D'Hoogh | |
| 6,697,496 | B2 * | 2/2004 | Frasl | H04R 7/20 181/171 |
| 7,275,620 | B1 * | 10/2007 | Diedrich | H04R 7/16 181/171 |
| 7,946,378 | B2 * | 5/2011 | Windischberger | H04R 7/20 181/157 |
| 9,253,576 | B2 * | 2/2016 | Tripp | H04R 9/04 |
| 10,129,652 | B2 * | 11/2018 | Vieites | H04R 7/26 |
| 2010/0158306 | A1 | 6/2010 | Inaba et al. | |
| 2010/0189304 | A1 | 7/2010 | Ueda et al. | |

FOREIGN PATENT DOCUMENTS

| | | | |
|---|---|---|---|
| JP | S58137400 | A | 8/1983 |
| JP | S59030399 | A | 2/1984 |
| JP | H10257590 | A | 9/1998 |

OTHER PUBLICATIONS

ISA/EP, International Search Report and Written Opinion for PCT Patent Application No. PCT/EP2016/066356, dated Sep. 30, 2016.

* cited by examiner

DIAPHRAGM SUSPENSION FOR A LOUDSPEAKER

CROSS REFERENCE TO RELATED APPLICATION(S)

This application is a 371 National Phase Application of PCT Patent Application No. PCT/EP2016/066356 filed on Jul. 8, 2016, which claims priority to United Kingdom Patent Application No. 1516297.7 filed on Sep. 15, 2015, the entire content of all of which is incorporated by reference herein.

FIELD OF THE INVENTION

This invention relates to a loudspeaker, preferably a loudspeaker in which an outer edge of the diaphragm is suspended from the chassis by an edge suspension, wherein the edge suspension has straight portions joined by corner portions. This invention also relates to a passive radiator and an edge suspension for suspending an outer edge of a diaphragm from a chassis in a loudspeaker.

BACKGROUND

With reference to FIG. 1, an electro-dynamic loudspeaker having a conventional design includes:

- a permanent magnet assembly typically comprising metal components 1*a* and a permanent magnet 1*b*
- a voice coil assembly typically comprising a wire referred to as a voice coil 2*a* wound/wrapped around a thin tube referred to as a voice coil former 2*b*
- a diaphragm 3
- a chassis 5 to which other acoustic components are secured
- a suspension system which suspends the diaphragm 3 from the chassis 5, typically including an edge suspension 4*a* and a spider 4*b*

This design is widely accepted in the industry because of the mechanical stability it provides.

The electro-dynamic loudspeaker of FIG. 1 works on the same basic principle as most electro-dynamic loudspeakers. A wire with a certain length is wound around the voice coil former 2*b* to form a solenoid more commonly referred to as the voice coil 2*a*. This forms the voice coil assembly which is positioned in an air gap 6. A static magnetic field is generated by the permanent magnet 1*b* in the air gap 6 and hence the voice coil assembly is positioned inside the static magnetic field generated by the permanent magnet 1*b*. When a current is applied at terminals of the solenoid, the solenoid generates a magnetic field which counteracts with the static magnetic field generated by the permanent magnet 1*b* of the permanent magnet assembly. The permanent magnet assembly and voice coil assembly collectively form a drive unit, with the permanent magnet assembly providing a stationary part of the drive unit secured to the chassis 5 and the voice coil assembly providing a translatable part of the drive unit secured to the diaphragm 3.

Since the permanent magnet assembly is secured to a rigid surface of the chassis 5, the force which is generated by the flowing current moves the diaphragm 3. The motion of the diaphragm 3 is preferably limited to a predetermined axis 8, which may be an axis of symmetry of the diaphragm 3, by the suspension system, preferably so that the voice coil 2 will always work in the most efficient portion of the static magnetic field generated by the permanent magnet 1*b* and will not come into contact the metal components 1*a* of the permanent magnet assembly (in the air gap 6).

A critical part of manufacturing and designing an electro-dynamic loudspeaker is to define the air gap 6. To improve the efficiency of a loudspeaker, it is desirable to design this air gap 6 to be as small as possible. Higher magnetic flux densities in the air gap 6 results in higher forces generated by the same current passing through the voice coil 2*a* windings compared to lower magnetic flux density in the air gap 6. Therefore the narrower the air gap 6 is, the higher the potential efficiency of the loudspeaker.

However, there are other design aspects which may force a designer to consider a wider air gap 6. One of them is the nature of the suspension system. The suspension system is typically made of soft materials, such as rubber, textile or paper, to enable the movement of the diaphragm 3 along the predetermined axis 8. Any movement of the diaphragm 3 and the voice coil assembly, which is mounted to it, in any direction other than along the predetermined axis 8 brings the voice coil 2*a* and the voice coil former 2*b* closer to the metal components 1*a* of the permanent magnet assembly. A contact, in the worst case, may generate unwanted noise or breaks contacts in the voice coil 2*a*, thereby stopping operation of the loudspeaker.

The suspension system preferably has two functions in an electro-dynamic loudspeaker. It preferably functions as a part of a single degree of freedom system ensuring that the diaphragm 3 moves only along the predetermined axis 8, and preferably further provides any required damping and/or stiffness to be able to fulfill a set of performance requirements. Thus, the suspension system preferably mechanically centres the voice coil assembly 2 in the air gap 6 during the travel (translation) of the diaphragm along the predetermined axis 8. For the suspension system 4 to be able to fulfill these preferred requirements, the components have to be designed within certain rules.

A suspension system usually includes two components, the first is referred to herein as the edge suspension 4*a* and the second is referred to herein as the spider 4*b*. The spider 4*b* may have other names in the industry, e.g. the "centering ring". The name "centering ring" reveals more about the function the spider 4*b* delivers in an electro-dynamic loudspeaker. The edge suspension 4*a* contributes to the stiffness and the damping parameters and also preferably establishes a sealing function between the front and the back sides of the diaphragm 3 thereby contributing to pressure built-up for the generation of sound.

The edge suspension 4*a* is typically mounted around the diaphragm 3 with a contact surface at an inner edge of the edge suspension 4*a* being attached to a contact surface at an outer edge of the diaphragm 3. A contact surface at an outer edge of the edge suspension 4*a* is preferably attached to a contact surface on the chassis 5 of the loudspeaker. The edge suspension 4*a* may e.g. be made out of rubber, foam, textile or paper in order to enable diaphragm 3 to move along the predetermined axis 8 of the loudspeaker. A contact surface at an inner edge of the spider 4*b* preferably attached to a contact surface on the voice coil former 2*b*. A contact surface at an outer edge of the spider 4*b* is preferably attached to a contact surface on the chassis 5.

The distance between (i) the contact surface on the chassis 5 at which the edge suspension 4*a* is attached to the chassis 5; and (ii) the contact surface on the chassis 5 at which the spider 4*b* is attached to the chassis 5 is referred to herein for brevity as the "distance between the suspension elements". This distance is directly related to the stability of the voice coil assembly 2 movement within the air gap 6.

The distance between the suspension elements can be changed depending on the application(s) intended for the loudspeaker. This distance is related to the height of a given loudspeaker and is further dependent on the dimensions of the diaphragm 3, how much excursion of the diaphragm 3 is required, the dimensions of the voice coil 2*a* as well as other parameters which affect the performance of the loudspeaker. In some cases, the distance between the suspension elements may need to be very small for a given loudspeaker, and may even be insufficient to establish the basic requirements of stable operation, for example when the electro-dynamic loudspeaker is needed to be built as flat as possible. Under these conditions, there may not be enough room for a spider 4*b*, but removal of the spider 4*b* can make a loudspeaker unstable to rocking. It is difficult to make a loudspeaker having the required stability with an edge suspension 4*a* being the only suspension element (i.e. with the spider 4*b* omitted).

It is common that, when there is no room for two suspension elements in a loudspeaker, the spider 4*b* is omitted. This is due to the fact that the edge suspension 4*a* normally functions as a sealing element between the front and back sides of the diaphragm 3 and therefore contributes to pressure built-up. When the spider 4*b* is omitted from the loudspeaker, the stability of the voice coil assembly in the air gap is greatly reduced. In this case, a resemblance can be made between a pendulum and the loudspeaker without a spider 4*b*. A heavy voice coil assembly, hung at the bottom of a diaphragm 3, is free to move in directions other than the predetermined axis 8.

Many attempts have been made to reduce the total height of a loudspeaker. One example is U.S. Pat. No. 6,385,327 B1, see in particular FIGS. 1, 2 and 3 of this document. In this document, a first set of blade springs which have a triangular cross-section are used around the diaphragm (providing an edge suspension) with a second set of blade springs being used around the voice coil former (providing a spider) to eliminate the movement of the voice coil assembly in the horizontal plane, making it possible for the diaphragm to move in along a symmetry axis of the loudspeaker. However, the blade springs are arranged in such a way that there are gaps (openings) in between adjacent blade springs, and so the blade springs fail to establish a sealing functionality, unlike like a more conventional edge suspension 4*a* as described above with reference to FIG. 1.

As shown by FIGS. 1, 2 and 3 of U.S. Pat. No. 6,385,327 B1, in the triangular cross-section of the blade springs, the bottom side of the triangle is left out so that two sides of the triangle are formed from a material. This enables the diaphragm to move freely over the symmetry axis of the loudspeaker.

As shown by FIG. 1 of U.S. Pat. No. 6,385,327 B1, the blade springs of U.S. Pat. No. 6,385,327 B1 leave openings in corner regions that are between the blade springs. These openings do not contribute to the pressure built-up (sealing between the front and back sides of the diaphragm) by the edge suspension of U.S. Pat. No. 6,385,327 B1. The absence of edge sealing is generally not desirable since it introduces acoustic short-cuts and greatly reduce the performance of a loudspeaker.

U.S. Pat. No. 4,056,697 introduces static or rigid elements which are closely positioned between the springs, with a view to improving the sealing of blade spring systems. This application also discloses a technique which allows the blade springs to be used without a spider element (unlike U.S. Pat. No. 6,385,327 B1, discussed above). As shown in FIG. 6 of U.S. Pat. No. 4,056,697, static or rigid elements 37 are introduced to reduce the size of the openings between the blade springs as much as possible to prevent the communication of the front side of the diaphragm with the back (or "rear") side and reduce the acoustic short cuts by sealing the edge of the diaphragm. However, whilst the elements 37 shown in FIG. 6 of U.S. Pat. No. 4,056,697 reduce the size of the openings between the blade springs, it is evident that this reduction does not provide complete sealing, and so when the loudspeaker of U.S. Pat. No. 4,056,697 is mounted in a small enclosure and has to make large volume displacements, the pressure difference between the front and the back sides of the diaphragm can becomes high enough for these small openings to introduce what are known as blowing noises. This blowing noise is a distinct problem in the industry and happens when there is a high velocity flow between a pressure maximum and a pressure minimum. Blowing noises are not desirable in loudspeaker designs and attempts are usually made to avoid this where possible.

For a shallow loudspeakers including a single suspension element, stability is very important. It is desirable for the loudspeaker to be as stable as possible, meaning that the voice coil should only move along a predetermined axis, with minimal off-axis (e.g. horizontal) displacement. However, if the loudspeaker has only a single suspension element, it will generally be unstable due to the introduction of rocking modes, which means that the voice coil will have some horizontal movement. To allow for these rocking modes, a designer will have to increase the size of the air gap in the loudspeaker design to prevent the voice coil assembly contacting the magnet assembly, reducing the efficiency of the design. This links the efficiency of the loudspeaker with the stability provided by the geometry of the edge suspension.

There have been proposals to reduce the displacement of the voice coil assembly in the horizontal plane. Blade springs and hinge mechanisms for blade springs have been proposed. However, known blade spring designs have air leakage and sealing problems between the front and the back sides of the diaphragm, as discussed above. The leakage problem introduces undesired effects that can be worse than those introduced by having a wide air gap. The present inventors believe this suggests that the edge suspension should where possible provide a seal between the front and the back sides of the diaphragm.

The present invention has been devised in light of the above considerations.

The present inventors believe it would be desirable to find a geometry for an edge suspension capable of being used in as the only suspension element in a loudspeaker that would eliminate the rocking of the voice coil assembly in the air gap, without degrading the linearity of the suspension, while also establishing a good seal between the front and the back sides of the diaphragm.

SUMMARY OF THE INVENTION

A first aspect of the invention may provide:

A loudspeaker including a chassis, a drive unit and a diaphragm;

wherein the drive unit has a stationary part secured to the chassis and a translatable part secured to the diaphragm;

wherein an outer edge of the diaphragm is suspended from the chassis by an edge suspension;

wherein the edge suspension has a plurality of straight portions, each straight portion having a respective first surface and a respective second surface which meet along an edge to provide a spring which permits the diaphragm to be moved relative to the chassis by the drive unit;

wherein the edge suspension has at least one corner portion, wherein the/each corner portion joins two of the straight portions together and includes at least one geometrical interruption formed therein;

wherein the/each geometrical interruption formed in the/each corner portion includes a first corrugation which varies in height along a first path which extends circumferentially around the edge suspension, and a second corrugation formed within the first corrugation which varies in height along a second path which extends across the first path.

By having at least one such geometrical interruption formed in the/each corner portion, the corner portion(s) are able to permit the diaphragm to be moved relative to the chassis by the drive unit (e.g. in "coil in" and "coil out" directions) in a manner that permits the/each corner portion to provide a continuous seal between the diaphragm and the chassis.

The/each first corrugation is preferably configured to accommodate relative movement between respective edges of adjacent straight portions joined by the first corrugation (e.g. towards and away from each other) when the diaphragm is moved relative to the chassis by the drive unit (e.g. in "coil in" and "coil out" directions).

The/each second corrugation is preferably configured to accommodate elongation of a distance between a first contact surface (e.g. glue surface, if glue is used to provide the attachment) at which the edge suspension is attached to the chassis, and a second contact surface (e.g. glue surface, if glue is used to provide the attachment) at which the edge suspension is attached to the diaphragm, when the diaphragm is moved relative to the chassis by the drive unit (e.g. in "coil in" and "coil out" directions).

For the avoidance of any doubt, a path which extends "circumferentially around" the edge suspension, in the context of this invention, means a path which extends along the edge suspension so as to pass around a location inwardly spaced from the edge suspension, e.g. a path along the edge suspension that extends around a centre of the diaphragm. Thus the term "circumferentially around" the edge suspension should not be interpreted as requiring the edge suspension to be circular (not least since the edge suspension is defined as having a plurality of straight portions).

The second path which extends across the first path may be perpendicular to the first path (at the point of crossing) and/or may extend radially out from the edge suspension (preferably within a plane in which the first path lies). In the context of this aspect of the invention, a path which extends "radially out" from the edge suspension means a path which extends outwardly from a location inwardly spaced from the edge suspension, e.g. a path that extends outwardly from a centre of the diaphragm. Again, the term "radially out" from the edge suspension should not be interpreted as requiring the edge suspension to be circular (not least since the edge suspension is defined as having straight portions).

The spring provided by each straight portion of the edge suspension may be referred to as a "blade spring" or a "delta spring". The terms "straight portion, "blade spring" and "delta spring" may therefore be used interchangeably herein. The spring provided by each straight portion may have a triangular cross section (with one side of the triangle omitted), but note that the respective first and second surfaces of a straight section might not be planar, and in any case may become deformed when the loudspeaker is in use. The spring provided by each straight portion of the edge suspension preferably provides a restoring force to urge the diaphragm back to a rest position when the diaphragm is moved relative to the chassis by the drive unit (e.g. in "coil in" and "coil out" directions), as can be seen in the discussion below. The edge of each straight portion preferably extends between two of the corner portions, though as noted below the edge of each straight portion may be continuous or may be non-continuous.

It may be useful to define a front side and a back side of the diaphragm, wherein the chassis and stationary part of the drive unit are located on the back side of the diaphragm. In use, the loudspeaker preferably projects sound waves out from a front side of the diaphragm, e.g. in the direction of a listener.

It may also be useful to define a front face and a back face of the diaphragm, wherein the back face of the diaphragm faces the chassis and stationary part of the drive unit.

It may be useful to define a front side and a back side of the edge suspension, wherein the chassis and stationary part of the drive unit are located on the back side of the edge suspension.

Preferably, the/each corner portion provides a continuous seal between the diaphragm and the chassis (i.e. with no gaps in the corner portion that would allow air to freely pass through the corner portion from one side of the diaphragm to the other). Preferably the entire edge suspension provides a continuous seal between the diaphragm and the chassis (i.e. with no gaps in the edge suspension that would allow air to freely pass through the edge suspension from one side of the diaphragm to the other), e.g. so as to provide a seal between front and back sides of the diaphragm.

The edge of each straight portion may be continuous or may be non-continuous. For example, the edge of each straight portion may be a non-continuous edge including a plurality of edge segments with the edge segments being separated by one or more geometrical interruptions formed in the straight portion (see e.g. FIG. 15).

Preferably the/each corner portion have a first surface and a second surface which meet along an edge. The edge of each corner portion may be curved.

The edge of the/each corner portion is preferably a non-continuous edge including a plurality of edge segments with the edge segments being separated by the at least one geometrical interruption formed in the corner portion.

The non-continuous edge of the/each corner portion may include a plurality of edge segments separated by at least two geometrical interruptions formed in the corner portion, more preferably separated by at least three geometrical interruptions formed in the corner portion.

The at least two/at least three geometrical interruptions formed in the/each corner portion may have differing sizes.

For example, the non-continuous edge of the/each corner portion may include a plurality of edge segments separated by three geometrical interruptions formed in the corner portion, wherein the three geometrical interruptions include an inner geometrical interruptions located between two outer geometrical interruptions. Preferably, for the/each corner portion, the inner geometrical interruption has a width and height that are smaller than the corresponding width and height of both of the outer geometrical interruptions (e.g. as in FIG. 7).

In other embodiments, the/each corner portion include the geometrical interruption extending all the way between adjacent straight portions, in which case the/each corner portion need not include a first surface and a second surface which meet along an edge Preferably, the first corrugation included in the/each geometrical interruption is a valley, e.g. a 'U' shaped valley or a 'V' shaped valley, wherein the valley is concave with respect to a front side of the edge suspension. If the/each corner portion has a first surface and a second surface which meet along an edge (see above), the first corrugation included in the/each geometrical interruption is preferably a valley which extends into a space formed between the first surface and the second surface (of the corner portion in which the geometrical interruption is included). These features help to reduce the height of the loudspeaker.

If the first corrugation included in each geometrical interruption is a valley, then preferably the second corrugation formed within each first corrugation is a hill, wherein the hill is convex with respect to (i.e. extends into the mouth of) the valley in which it is formed.

Preferably, the distance by which each hill extends into the mouth of the valley in which it is formed is less than half the depth of the valley in which it is formed. In this way the flexibility of the first corrugation is not unduly limited by the intrusion of the second corrugation.

In some embodiments, the first corrugation included in the/each geometrical interruption may be a hill, e.g. an inverted 'U' shaped hill or an inverted 'V' shaped hill, wherein the hill is convex with respect to a front side of the edge suspension. In this case, the second corrugation formed within each second corrugation may be a valley formed within (preferably at a top of) the hill, wherein the valley is concave with respect to (i.e. extends into) the hill in which it is formed.

A shape or inverted 'U' shape is preferred for the valley/hill over a 'V' shape or inverted 'V' shape, mainly because of feasibility regarding manufacturing (tooling) and also since materials that could be used for the diaphragm (e.g. cloth and many other sheet materials) do not allow such sharp complex shapes.

Preferably, each straight portion of the edge suspension includes a first contact surface (e.g. glue surface, if glue is used to provide the attachment) at which the straight portion is attached to the chassis, and a second contact surface (e.g. glue surface, if glue is used to provide the attachment) at which the straight portion is attached to the diaphragm.

Preferably, each corner portion of the edge suspension includes a first contact surface (e.g. glue surface, if glue is used to provide the attachment) at which the corner portion is attached to the chassis, and a second contact surface (e.g. glue surface, if glue is used to provide the attachment) at which the corner portion is attached to the diaphragm.

Preferably the edge suspension is the only suspension element by which the diaphragm is suspended (directly or indirectly) from the chassis. For example the loudspeaker may be made without a spider which suspends the translatable part of the drive unit from the chassis (thereby indirectly suspending the diaphragm from the chassis). By omitting a spider, the overall depth of the loudspeaker can be reduced to allow manufacture of a low profile loudspeaker.

Having the edge suspension as the only suspension element puts higher demands on the edge suspension when it comes to avoiding/reducing rocking mode behaviour of the loudspeaker. To counter this, the straight portions are preferably adequately stiff across their first and second surfaces whilst being able to bend at the edge along which the first and second surfaces meet. Therefore, each straight portion preferably includes one or more stiffening elements as described below.

Preferably the edge of each straight portion is flexible and forms a hinge between the first surface and the second surface.

Each straight portion may include one or more stiffening elements. The one or more stiffening elements included in each straight portion are preferably configured to stiffen the straight portion across its first and second surfaces whilst allowing the straight portion to bend at the edge at which its first and second surfaces meet.

By way of example, the one or more stiffening elements may include one or more geometrical interruptions formed in each straight portion, one or more ridges on the first surface and/or on the second surface of each straight portion, and/or one or more one planar sheets of material (e.g. a metal material such as copper or steel) attached to the first surface and/or to the second surface of each straight portion.

Preferably, the one or more stiffening elements included in each straight portion include one or more geometrical interruptions, since this helps to simplify the manufacturing process (since one piece to manufacture means one tooling and one material, which in turn means reduced handling and reduced cost).

The one or more geometrical interruptions formed in each straight portion may have a form previously described in relation to the geometrical interruption formed in the/each corner portion.

For example, the/each geometrical interruption formed in each straight portion may include a first corrugation which varies in height along a first path which extends circumferentially around the edge suspension, and a second corrugation formed within the first corrugation which varies in height along a second path which extends across the first path. Having geometrical interruptions with this form allows each straight portion to be stiffened across its first and second surfaces whilst allowing the straight portion to bend at the edge at which its first and second surfaces meet.

As with the geometrical interruptions formed in the/each corner portion, for each straight portion, the first corrugation included in the/each geometrical interruption may be a valley, e.g. a shaped valley or a 'V' shaped valley, wherein the valley is concave with respect to a front side of the edge suspension. Similarly, the second corrugation formed within the/each first corrugation may be a hill, e.g. an inverted 'U' shaped hill or an inverted 'V' shaped hill, wherein the hill is convex with respect to the valley in which it is formed.

The edge suspension may comprise a metal material such as copper or steel. This can reduce the internal damping of the loudspeaker and increase the stiffness of the edge suspension.

The edge suspension may comprise a textile material, or a paper material. This can increase the internal damping of the loudspeaker, which may be preferable in certain applications.

Preferably, the/each corner portion is made from the same material as the straight portions. The material may be a textile material or a paper material. More preferably the/each corner portion is integrally formed with the straight portions. However, the/each corner portion may be made from a different material to the straight portions.

Preferably, the edge suspension has a plurality of corner portions, wherein each corner portion joins (respectively) two of the straight portions together and (respectively) includes at least one geometrical interruption formed therein. In this way, the entire edge suspension can be made to provide a continuous seal between the diaphragm and the chassis (i.e. with no gaps in the edge suspension that would allow air to freely pass through the edge suspension from one side of the diaphragm to the other), e.g. so as to provide a seal between front and back sides of the diaphragm.

The edge suspension may comprise n straight portions and n corner portions, where n is an integer that is 3 or more. For example, the edge suspension may comprise 3 straight portions and 3 corner portions to form a triangular shape. For example, the edge suspension may comprise 4 straight portions and 4 corner portions to form a square/rectangular shape. A low value of n is preferred for reasons of stability, and n=4 is particularly preferred, as this gives a diaphragm having greater surface area than n=3.

Preferably the edge suspension comprises four straight portions and four corner portions to form a square/rectangular shape. Other shapes are of course possible, as would be appreciated by a skilled person in light of the present disclosure.

Preferably the diaphragm includes a membrane. The membrane may be lightweight, stiff and/or internally damped in order to provide optimum sound quality. Preferably the diaphragm is shaped to provide a large surface area for efficient radiation of sound. For example, the diaphragm may include a dished portion (that may e.g. include a dome or a cone shape portion).

The diaphragm may be concave or convex with respect to a front side of the diaphragm. For example, if the diaphragm includes a dome, the dome may be convex with respect to a front side of the diaphragm. For example, if the diaphragm includes a cone shaped portion, the cone shaped portion may be concave ("cone") or convex ("inverted cone") with respect to a front side of the diaphragm.

The diaphragm may be made of any material that allows for the effective radiation of sound. Suitable materials may include paper, copper, steel, aluminium, textile material, as well as various other synthetic materials. The use of a metal material can reduce the internal damping of the loudspeaker and increase the stiffness of the diaphragm. The use of paper or textile material has the advantage of being lightweight and well internally damped.

Preferably, the translatable part of the drive unit includes a voice coil (which may form part of a voice coil assembly) coupled to the diaphragm, and the stationary part of the drive unit includes a permanent magnet (which may form part of a permanent magnet assembly). The voice coil is preferably configured to interact with a static magnetic field of the permanent magnet when an electric current is passed through the voice coil. The voice coil may be coupled to the diaphragm directly or indirectly, for example the voice coil may be wound/wrapped around a voice coil former which is directly attached to a back face of the diaphragm. The voice coil and voice coil former may form a voice coil assembly which may provide the translatable part of the drive unit. The permanent magnet and other components (e.g. metal components) may form a permanent magnet assembly which may provide the stationary part of the drive unit.

An interaction between the voice coil and the static magnetic field of the permanent magnet preferably results in movement of the voice coil along a predetermined axis. The predetermined axis may be perpendicular to the first path (the path which extends circumferentially around the edge suspension). For example, this axis may be an axis of rotational symmetry of the diaphragm and in this case may be called the "symmetry axis".

A "coil in" direction may be defined as a direction in which the diaphragm (and/or voice coil) is moved (e.g. along the predetermined axis defined above) towards the permanent magnet, e.g. due to an interaction between the voice coil and the static magnetic field of the permanent magnet.

A "coil out" direction may be defined as being opposite to the "coil in" direction. Thus, a "coil out" direction may be defined as a direction in which the diaphragm (and/or voice coil) is moved (e.g. along the predetermined axis defined above) away from the permanent magnet, e.g. due to an interaction between the voice coil and the static magnetic field of the permanent magnet.

Preferably the chassis is a rigid frame which acts to stabilise the loudspeaker and may hold one or more components of the loudspeaker in position relative to one another. Preferably the chassis has at least one side wall to define an interior space, wherein a back face of the diaphragm faces towards the interior space. For example the sidewalls may define a concave interior space, with the front face of the diaphragm facing outwardly from an opening in the chassis.

In some embodiments the chassis may be mounted in a housing, for example a loudspeaker enclosure or a loudspeaker cabinet.

A second aspect of the invention may provide a passive radiator having the same or similar features to a loudspeaker according to the first aspect of the invention, except that the drive unit is omitted.

A "passive radiator" (also "passive slave" or "drone cone") is a component typically used to tune the frequency response in a loudspeaker enclosure.

A passive radiator according to the second aspect of the invention may therefore include a chassis and a diaphragm;

- wherein an outer edge of the diaphragm is suspended from the chassis by an edge suspension;
- wherein the edge suspension has a plurality of straight portions, each straight portion having a respective first surface and a respective second surface which meet along an edge to provide a spring which permits the diaphragm to be moved relative to the chassis;
- wherein the edge suspension has at least one corner portion, wherein the/each corner portion joins two of the straight portions together and includes at least one geometrical interruption formed therein;
- wherein the/each geometrical interruption formed in the/each corner portion includes a first corrugation which varies in height along a first path which extends circumferentially around the edge suspension, and a second corrugation formed within the first corrugation which varies in height along a second path which extends across the first path.

Advantages of a loudspeaker according to the first aspect of the invention may also apply to a passive radiator according to the second aspect of the invention.

The passive radiator may have any feature described in connection with the first aspect of the invention, with the drive unit being omitted.

The passive radiator may be configured to permit the mass of the diaphragm to be adjusted, e.g. for the purposes of tuning the passive radiator to a loudspeaker enclosure.

A third aspect of the invention may provide an edge suspension for suspending an outer edge of a diaphragm from a chassis in a loudspeaker according to the first aspect of the invention.

The edge suspension according to the third aspect of the invention may have or be configured for use with any feature described above in connection with the first aspect of the invention.

The invention also includes any combination of the aspects and preferred features described herein (including the description of a typical electro-dynamic loudspeaker with reference to FIG. 1) except where such a combination is clearly impermissible or expressly avoided.

BRIEF DESCRIPTION OF THE DRAWINGS

Examples of these proposals are discussed below, with reference to the accompanying drawings in which:

FIG. 3(*b*) shows the same two adjacent blade springs of the loudspeaker of FIG. 2 when the voice coil is moved in the coil out direction.

DETAILED DESCRIPTION

When blade springs and their hinge mechanisms are examined, it can be observed that their movement is very complex, especially at the sides.

Figure 3A:
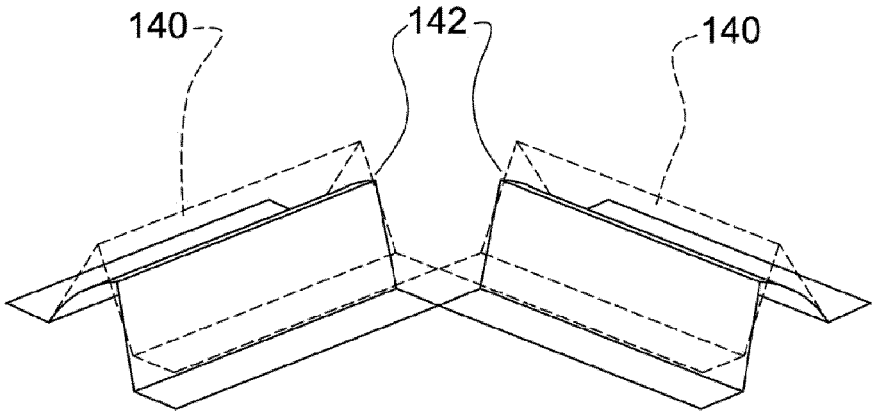
FIG. 3(*a*) shows two adjacent blade springs of the loudspeaker of FIG. 2 when the voice coil is moved in the coil in direction.
Figure 3B:
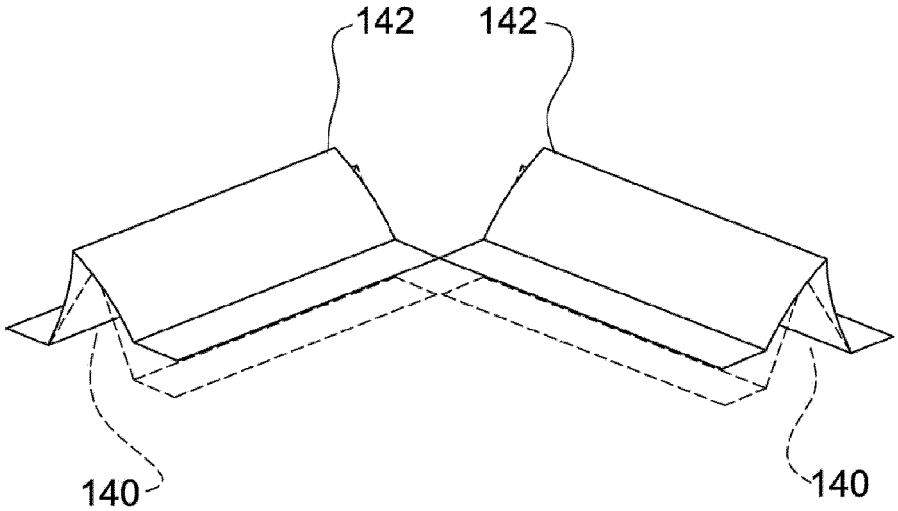
Figure 4:
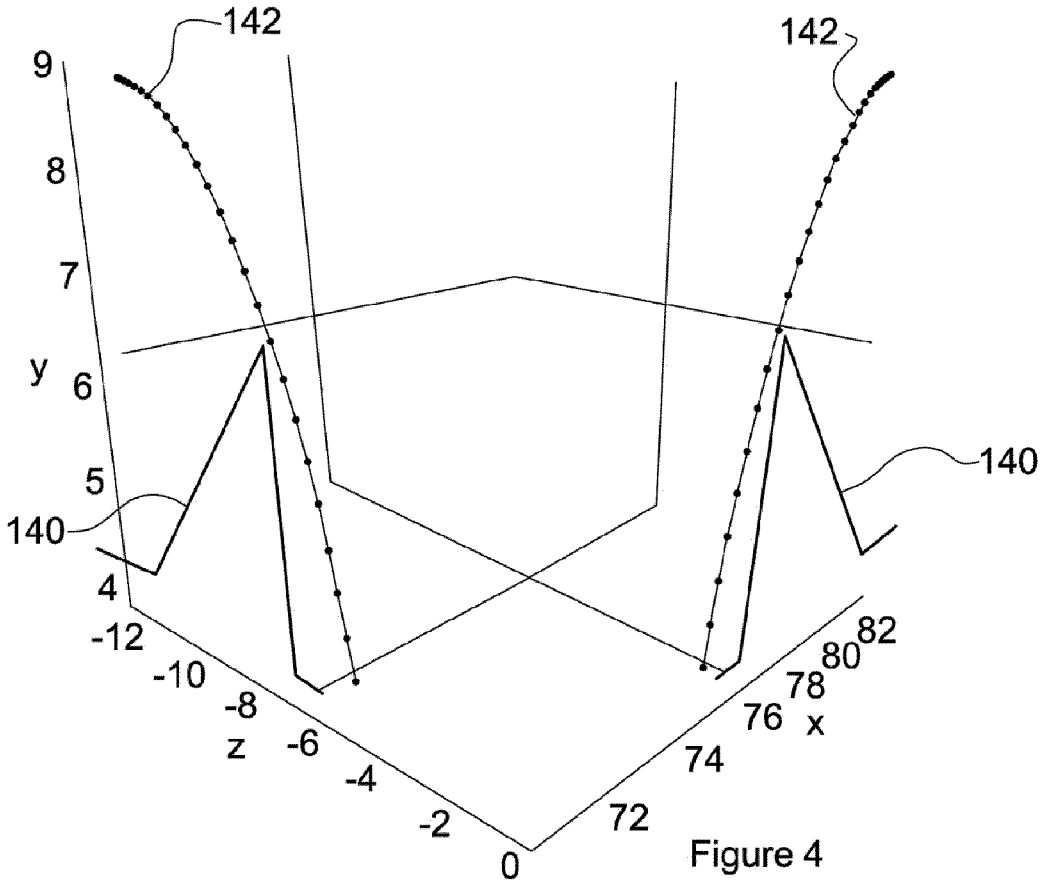
FIG. 4 shows a 3-dimensional ("3D") representation of the trajectories of the edges of the two blade springs shown in FIGS. 3(*a*) and 3(*b*).

As shown by FIG. 4 of U.S. Pat. No. 4,056,697 and FIG. 3 of U.S. Pat. No. 6,385,327 B1, it can be seen that blade springs deform as a diaphragm travels along a symmetry axis of a loudspeaker. In addition, the hinge mechanism joining the surfaces of the blade springs moves in a direction which is perpendicular to the symmetry axis of the loudspeaker.

Figure 2:
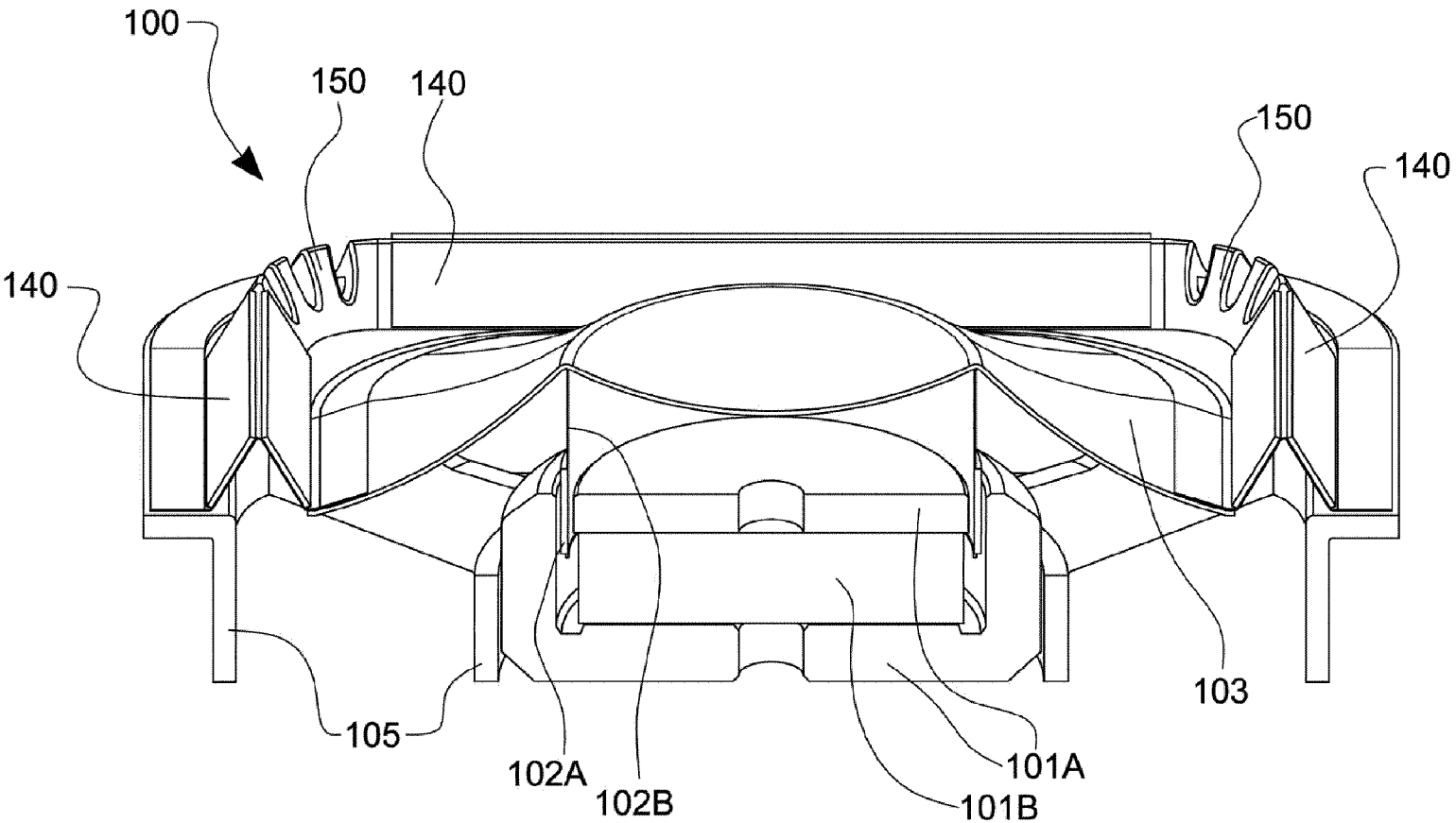
FIG. 2 shows a cross-sectional view of an electro-dynamic loudspeaker according to the present invention.

FIG. 2 shows an example loudspeaker 100 that includes a chassis 105, a drive unit and a diaphragm 103.

The drive unit has a stationary part secured to the chassis 105 and a translatable part secured to the diaphragm 103.

The translatable part of the drive unit includes a voice coil 102*a* coupled to the diaphragm 103 via a voice coil former 102*b* around which the voice coil 102*a* is wrapped. The stationary part of the drive unit includes metal components 101*a* and a permanent magnet 101*b*. The voice coil 102*a* and voice coil former together form the translatable part of the drive unit. The metal components 101*a* and permanent magnet 101*b* together form the stationary part of the drive unit.

An outer edge of the diaphragm is suspended from the chassis by an edge suspension 104 that has a plurality of straight portions 140 and a plurality of corner portions 150, wherein each corner portion 150 (respectively) joins two of the straight portions 140 together and (respectively) includes at least one geometrical interruption formed therein. The corner portions 150 are not visible in FIG. 2, but can be seen in FIG. 7 (discussed below).

Each straight portion has a respective first surface 141*a* and a respective second surface 141*b*, which meet along an edge 142 which extends between two of the corner portions to provide a blade spring 140 which permits the diaphragm 103 to be moved along a predetermined axis 108 relative to the chassis 105 by the drive unit. The straight portions 140 are referred to as blade springs 140 herein.

Although FIG. 2 depicts a loudspeaker 100, it would be possible to instead provide a passive radiator by omitting the drive unit (i.e. by omitting the metal components 101*a*, permanent magnet 101*b*, voice coil 102*a* and voice coil former 102*b*) from the loudspeaker of FIG. 2. A "passive radiator" (also "passive slave" or "drone cone") is a component typically used to tune the frequency response in a loudspeaker enclosure. The possibility of a passive radiator will not be discussed further herein, though a skilled person would appreciate that many of the features described in relation to the loudspeaker 100 could equally be applied to a passive radiator in which the drive unit is omitted.

As shown by FIGS. 3(*a*) and 3(*b*), when the loudspeaker 100 of FIG. 2 is in use, the following deformations can be observed in adjacent blade springs 140:

1. When the voice coil 102*a* moves in a "coil in" direction (i.e. towards the permanent magnet 101*b*), the edges 142 of the blade springs 140 (which can be viewed as the tips of a triangle formed by each blade spring 140, when viewed in cross section) move closer to each other, as shown in FIG. 3(*a*); and
2. When the voice coil 102*a* moves in a "coil out" direction (i.e. away from the permanent magnet 101*b*), the edges 142 of the blade springs 140 move away from (i.e. separate from) each other, as shown in FIG. 3(*b*).

Note that since the voice coil 102*a* is secured to the diaphragm 103 of the loudspeaker 100, the "coil in" and "coil out" directions can also be used to describe a direction of movement of the diaphragm 103.

From FIGS. 3(*a*) and 3(*b*) it can be seen that the edges 142 of the adjacent blade springs 140 are moving relative to each other along an axis which is perpendicular to the symmetry axis 108 of the diaphragm 103. More accurately, when the trajectories of the edges 142 are observed, it can be seen that they are following an arc shaped line in 3-dimensional space, as shown in FIG. 4. These two arcs that are formed with the two edges 142 of two adjacent blade springs 140 get closer when the diaphragm moves in the coil in direction and they get further apart from each other when the diaphragm moves in the coil out direction.

The fact that the edges 142 of the blade springs 140 of FIGS. 3(*a*) and 3(*b*) are in relative movement towards and away from each other when the loudspeaker 100 is in use suggests to the present inventors that any construction placed in between these two blade springs 140 to establish sealing between the front and the back sides of the diaphragm should permit this relative movement in order not to degrade the linearity of the suspension provided by the edge suspension 104.

In FIG. 4, the dotted curves represent the movement of the edges 142 of the respective blade springs 140. A basic drawing of the cross-section of the blade springs 140 has been added to the graph of FIG. 4 to indicate the rest position of the springs.

FIG. 4 illustrates that, when blade springs 140 are positioned to form a 90-degrees angle between them, the planes in which the trajectories of the edges 142 are contained are perpendicular to each other. In more detail, the trajectory of the edge 142 shown on the left of FIG. 4 is contained in the y-z plane and the trajectory of the edge 142 shown on the right of FIG. 4 is contained in the x-y plane. As both of the blade springs 140 are connected to the diaphragm 103, when the diaphragm 103 moves the edges 142 of each spring remain at the same height as each other. Thus, each point on one trajectory curve has a corresponding point on the other trajectory curve, showing that there is no relative movement in the y-axis between the two spring elements 140. It is possible to define a middle point between the two trajectories, which will also define a middle plane. In the case of 90-degree placement of the two blade springs 140, the middle plane lies at 45-degrees angle from each trajectory plane.

Figure 5:
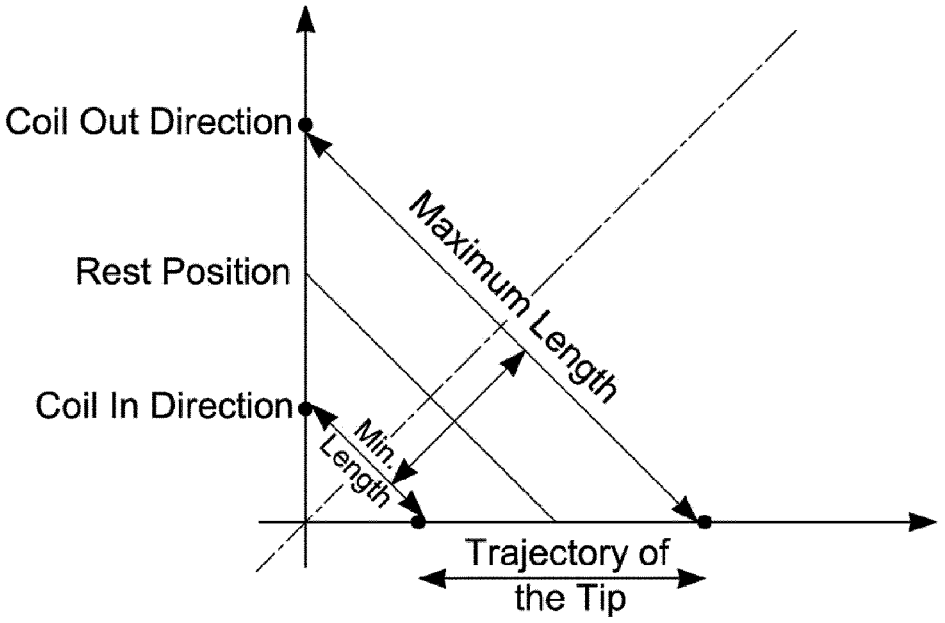
FIG. 5 shows a 2-dimensional ("2D") projection of the 3D trajectories shown in FIG. 4.

FIG. 5 shows the graph of FIG. 4 from above, i.e. the x-z plane of FIG. 4. The middle plane referred to above is indicated with a dotted line in FIG. 5.

In FIG. 5, the horizontal axis shows the trajectory of the edge 142 of the blade spring 140 shown on the right of FIG. 4 and the vertical axis shows the trajectory of the edge 142 of the blade spring 140 shown on the left of FIG. 4. As shown by FIG. 5, the distance between the edges 142 varies between a minimum length when the diaphragm 103 has moved by its maximum extent in the coil in direction and a maximum length when the diaphragm 103 has moved by its maximum extent in the coil out direction.

Figure 1:
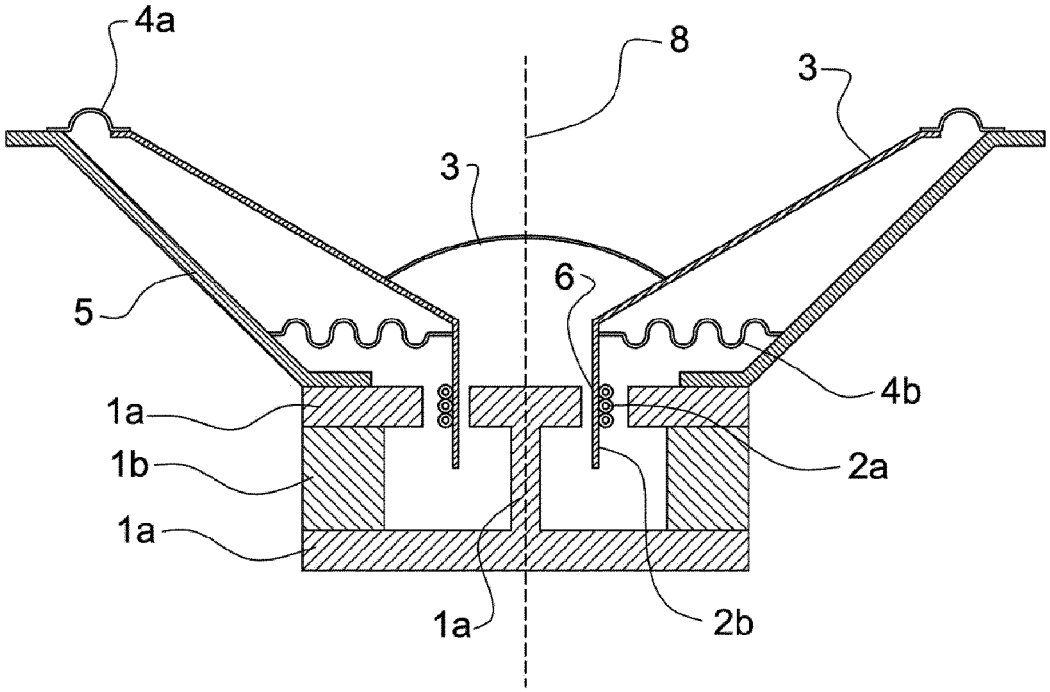
FIG. 1 shows a cross-sectional view of an electro-dynamic loudspeaker having a conventional design.

When the conventional loudspeaker design of FIG. 1 is examined in view of these considerations, one may notice components which are made to expand and contract. Examples of such components include the spider 4*b* and edge suspension 4*a*. These elements are formed in such a way that their geometric stiffness will be dominant over their material stiffness. This is achieved by making them from a piece of material that is longer than the distance that they have to travel.

Figure 6:
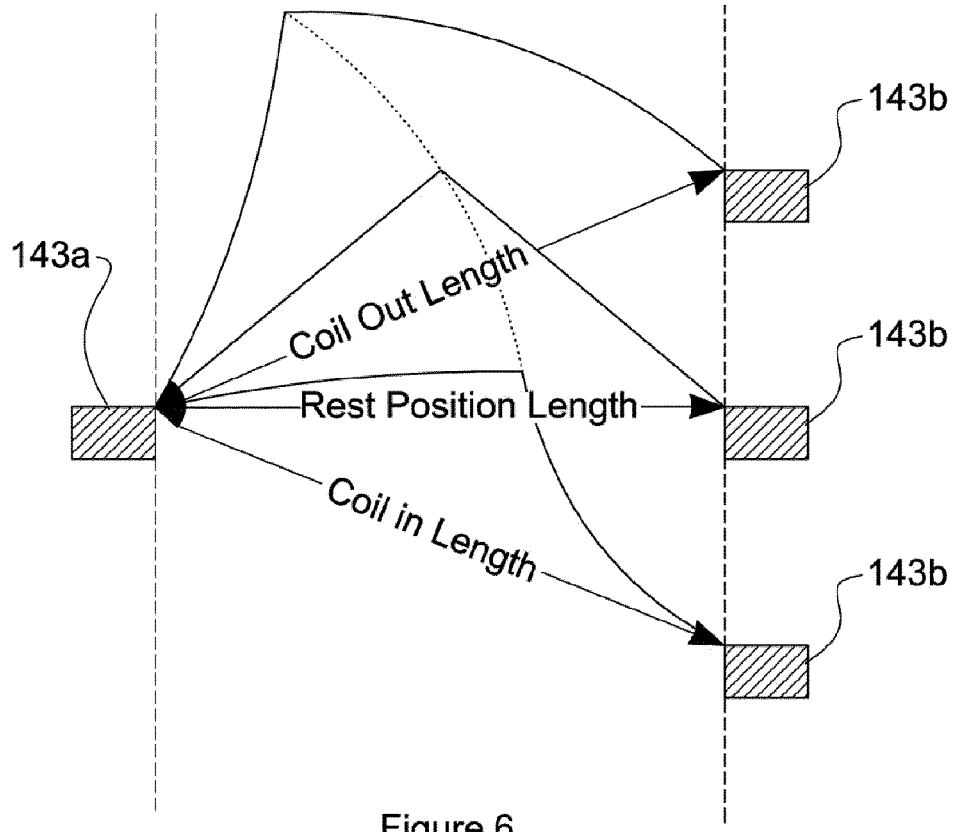
FIG. 6 shows elongation of a distance between glue surfaces on a blade spring of the loudspeaker of FIG. 2 when the diaphragm is moved in the coil in and coil out directions.

FIG. 6 illustrates a first glue surface 143*a* at which a blade spring 140 is attached to the chassis 105; and a second glue surface 143*b* at which the blade spring 140 is attached to the diaphragm 103, when the diaphragm 103 is moved relative to the chassis 105 by the drive unit in "coil in" and "coil out" directions. As illustrated by FIG. 6, it can be seen that the distance between the first and second glue surfaces 143*a*, 143*b* always increases (elongates) when the voice coil 102*a*/diaphragm 103 travels away from its rest position, regardless of whether the voice coil 102*a*/diaphragm 103 is moved in the coil in or the coil out direction.

A suspension element (e.g. a spider or edge suspension) usually has two contact surfaces. A first contact surface is used to attach (e.g. using glue) the suspension element to a rigid surface, like the chassis 105, with the second contact surface being used to attach the suspension element to a moving surface, like the diaphragm 103 or the voice coil former 102*b*. In any construction of a loudspeaker, the distance between these surfaces is normally at its shortest value when the voice coil 102*a*/diaphragm 103 is at its rest position. When the voice coil assembly and the other acoustic components of a loudspeaker start to travel in one direction, the suspension element(s) start to stretch and generate a reaction force to urge the voice coil 102*a*/diaphragm 103 back to its rest position. For a conventional suspension element such as the edge suspension 4*a* or spider 4*b* of FIG. 1, the reaction force, generated by stretching the suspension element, is normally mostly obtained from the geometrical stiffness of the element. This can be explained by understanding that there is a distinction between unbending a suspension element that has been bent (where stiffness is provided geometrically, by the bending of the element), and stretching material the suspension element is made of (where stiffness is provided by the material the suspension element is made of). When the geometrical stiffness provided by bending of the element is dominant over the stretching of the material, the stiffness curve of the suspension element is under the control of the geometry of the suspension element rather than the material properties of the material.

As discussed in the background section (above), the use of blade springs in an edge suspension can introduce problems due a lack of sealing at corners of the edge suspension. However, providing sealing at the corners of an edge suspension that incorporates blade springs is difficult, for reasons that shall now be discussed.

In detail, when the gap between the two blade springs 140 of FIG. 3(*a*) and FIG. 3(*b*) is closed using a corner portion which provides a simple continuation of the edges 142 of the blade springs 140 while they are at their rest positions (see e.g. FIG. 9), it is evident that the diaphragm 103 will not be able to move away from its rest position because the material from which the corner portion is made will need to be stretched before the blade springs 140 can deform to allow the diaphragm 103 to be moved from its rest position. In order to make the displacement of the diaphragm 103 possible, the present inventors believe that a corner portion which can expand and contract should be used to join the blade springs 140.

In view of these considerations, the present inventors believe that corner portions which join the blade springs 140 would ideally fulfill the following requirements:

1. The effect of the corner portion on the stiffness of the blade springs 140 should be small (e.g. as small as possible); and
2. The corner portion should be able to seal the front side of the diaphragm 103 from the back side of the diaphragm 103.

Figure 7:
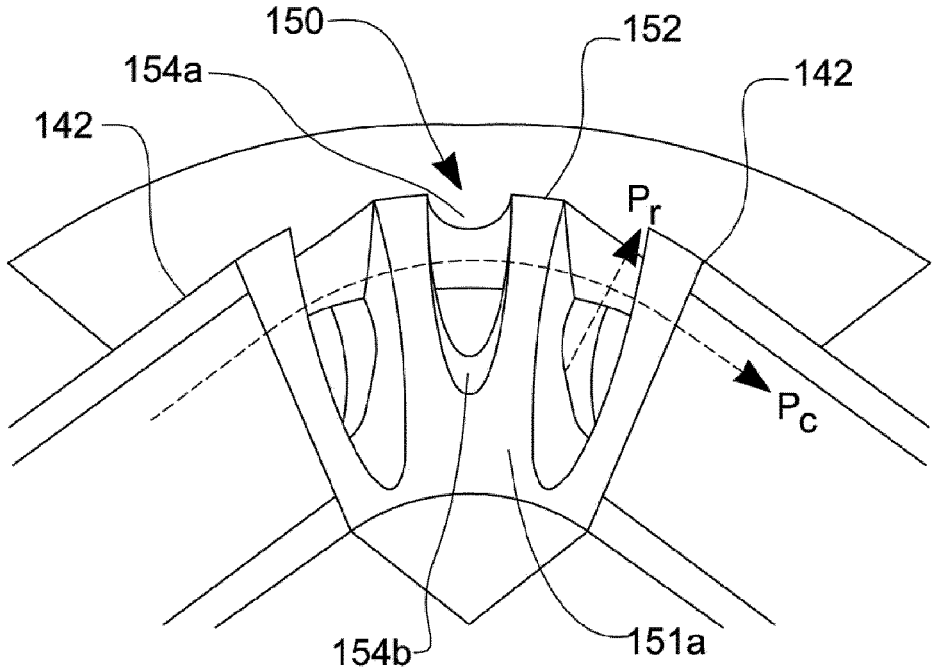
FIG. 7 shows an example corner portion for joining two blade springs, wherein three geometrical interruptions are formed in the corner portion.

FIG. 7 shows an example corner portion 150 for joining two blade springs 140 that has been devised by the present inventors.

The corner portion 150 has a first surface 151*a* and a second surface 151*b* (obscured from view in FIG. 7) which meet along an edge 152. The corner portion 150 also has at least one (in this example three) geometrical interruptions.

Each geometrical interruption includes:

1. A top surface interruption 154*a*: this is a first corrugation which varies in height along a first path $P_c$ which extends circumferentially around the edge suspension 110. In this example, the first corrugation is a 'U' shaped valley that is concave with respect to a front side of the edge suspension 104 and has its widest opening adjacent to the edge 152 of the corner portion 150. Note that the edge 152 is a non-continuous edge including a plurality of edge segments separated by the top surface interruptions 154*a*; and
2. A bottom surface interruption 154*b*: this is a second corrugation formed within the top surface interruption which varies in height along a second path $P_r$ which extends across the first path $P_c$ (note that each second corrugation is defined with reference to a separate, respective second path $P_r$, though only one such path is shown in FIG. 7). In this example, the second path $P_r$ extends radially out from the edge suspension 104 within a plane in which the first path $P_c$ lies. In this example, the second corrugation is an inverted 'U' shaped hill that is convex with respect to the front side of the edge suspension 104 and has its widest opening at the bottom of a space formed between the first surface 151*a* and a second surface 151*b* of the corner portion 150.

The considerations that led to the proposed geometry of the corner portion 150 shown in FIG. 7 can be understood by the following discussion.

Figure 8:
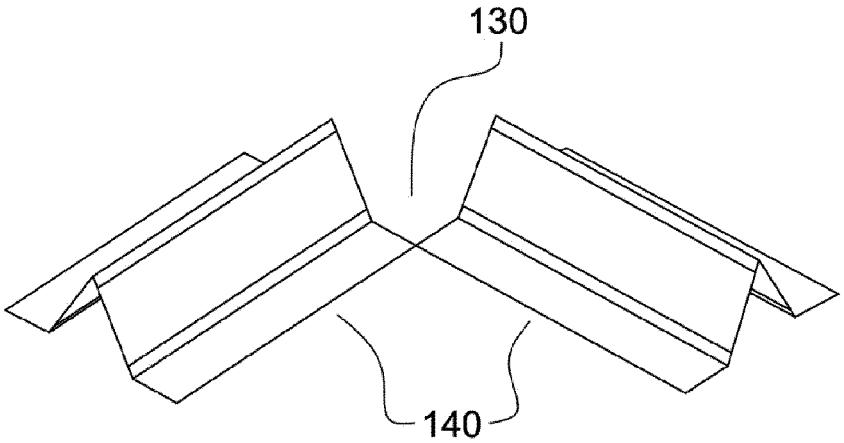
FIG. 8 shows two blade springs which are not joined by a corner portion.
Figure 9:
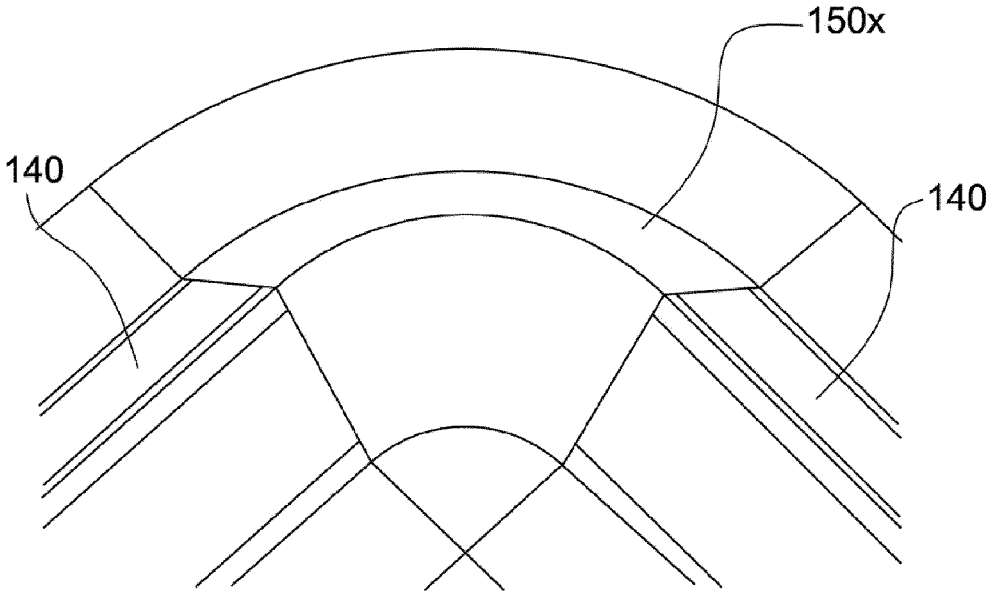
FIG. 9 shows an example corner portion for joining two blade springs, wherein no geometrical interruptions are formed in the corner portion.

A gap 130 between two adjacent blade springs 140 as shown in FIG. 8 could in theory be closed by continuing/extending the blade springs 140 around a curved path to provide a corner portion 150*x*, as shown in FIG. 9. However, this introduces further problems; because this corner portion 150*x* is not flexible, the material will be stretched when the diaphragm 103 is moved in either the coil in or coil out directions, and so the stiffness performance of the blade springs 140 will be adversely affected.

Figure 10:
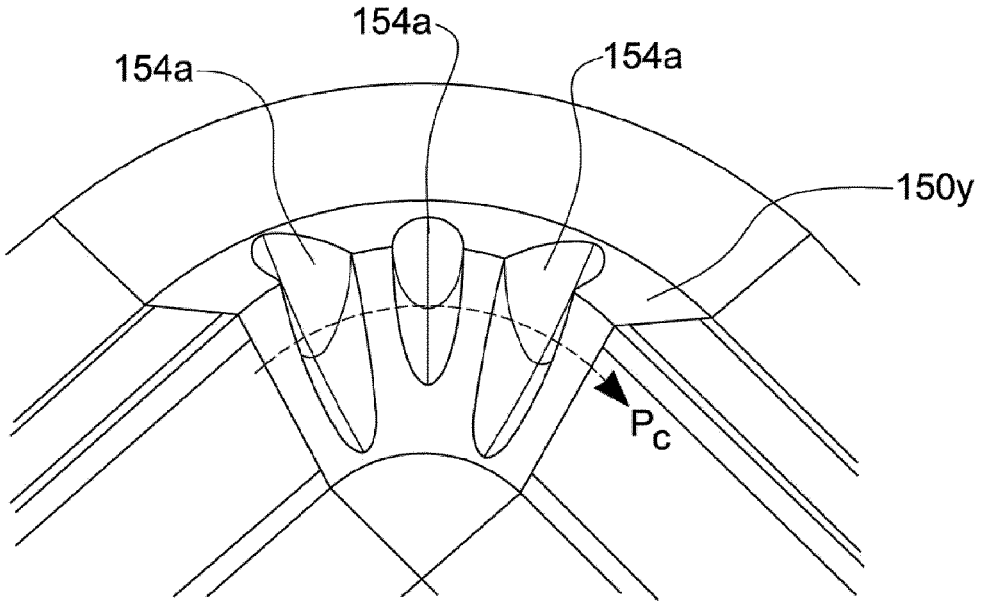
FIG. 10 shows an example corner portion for joining two blade springs, wherein three geometrical interruptions that include only top surface interruptions are formed in the corner portion.

To solve this issue, the present inventors introduced the top surface interruptions 154*a* to provide a corner portion 150*y*, as shown in FIG. 10. The top surface interruptions 154*a* have the ability to expand and contract when the voice coil 102*a*/diaphragm 103 move in the coil in or coil out directions. When the distance between the edges 142 of the blade springs 140 gets smaller (for example when the diaphragm 103 is moved in the coil in direction), the side walls of each top surface interruption 154*a* approach each other and geometrically absorb the deformation, without the need to stretch the material from which the corner portion 150*y* is formed. When the distance between the edges 142 of the blade springs 140 gets larger (for example when the diaphragm 103 is moved in the coil out direction), the side walls of each top surface interruption 154*a* separate from each other and enable the blade springs 140 to move freely. The top surface interruptions can therefore be seen as permitting relative movement between the edges 142 of the blade springs 140.

As can be seen from FIG. 10, the base of the top surface interruptions 154*a* introduce a potential problem. It was mentioned previously that the blade springs 140 have only two sides of a triangle when viewed in cross-section. This is because having a third (lower) side of a triangle when viewed in cross-section would limit the movement of the diaphragm along the predetermined axis 108 of the loudspeaker. It has already been discussed with reference to FIG. 6 that the distance between first and second glue surfaces 143*a*, 143*b* on a blade spring 140 gets larger as the diaphragm 103 moves away from its rest position in either the coil in or coil out directions. The bases of the top surface interruptions 154*a* in the corner portion 150*y* as shown in FIG. 10 would therefore severely restrict movement of the diaphragm 103 in the coil in and coil out directions, since the distance between the first and second glue surfaces 143*a*, 143*b* on the blade springs 140 could only be elongated through stretching the material at the base of the top surface interruptions 154*a*.

In view of the above considerations, the present inventors added the bottom surface interruptions 154*b* to provide a corner portion 150, as shown in FIG. 7. The bottom surface interruptions 154*b* allow the bases of the top surface interruptions 154*a* to expand as the coil moves in either the coil in or coil out directions, and therefore allow the distance between the first and second glue surfaces 143*a*, 143*b* on the blade springs 140 to be increased when the voice coil 102*a*/diaphragm 103 moves away from its rest position in either the coil in or coil out directions, without needing to stretch the material at the base of the top surface interruptions 154*a*. These bottom surface interruptions 154*b* therefore add flexibility to the bases of the top surface interruptions 154*a*.

However, it is to be recognized that the presence of the bottom surface interruptions 154*b* add rigidity along the first path $P_c$, thereby limiting the flexibility of the top surface interruptions 154*a*. For this reason, the bottom surface interruptions 154*b* preferably do not extend through the total depth of the top surface interruptions 154*a*. More preferably, the height of the bottom surface interruptions 154*b* does not exceed half the height of the top surface interruptions 154*a*, to allow the side walls of the top surface interruptions 154*a* to stay adequately flexible.

The corner portion 150 of FIG. 7 can therefore be used to join blade springs 140 in a manner that permits relative movement between the edges 142 of the blade springs 140, whilst allowing the distance between first and second glue surfaces 143*a*, 143*b* on the blade springs 140 to be increased when the voice coil 102*a*/diaphragm 103 moves away from its rest position in either the coil in or coil out directions.

The edge suspension 104 of FIG. 2, whose blade springs 140 are joined by corner portions 150 as shown in FIG. 7, can be integrally formed out of a single material, such as copper or steel, for stiffness and to provide stability. Other materials for making the edge suspension include foam, textile or paper which are flexible in many directions. Use of copper or steel may reduce internal damping of the loudspeaker where other materials may have large amounts of internal damping; the amount of damping which is desirable depends on the application of the loudspeaker.

Figure 11:
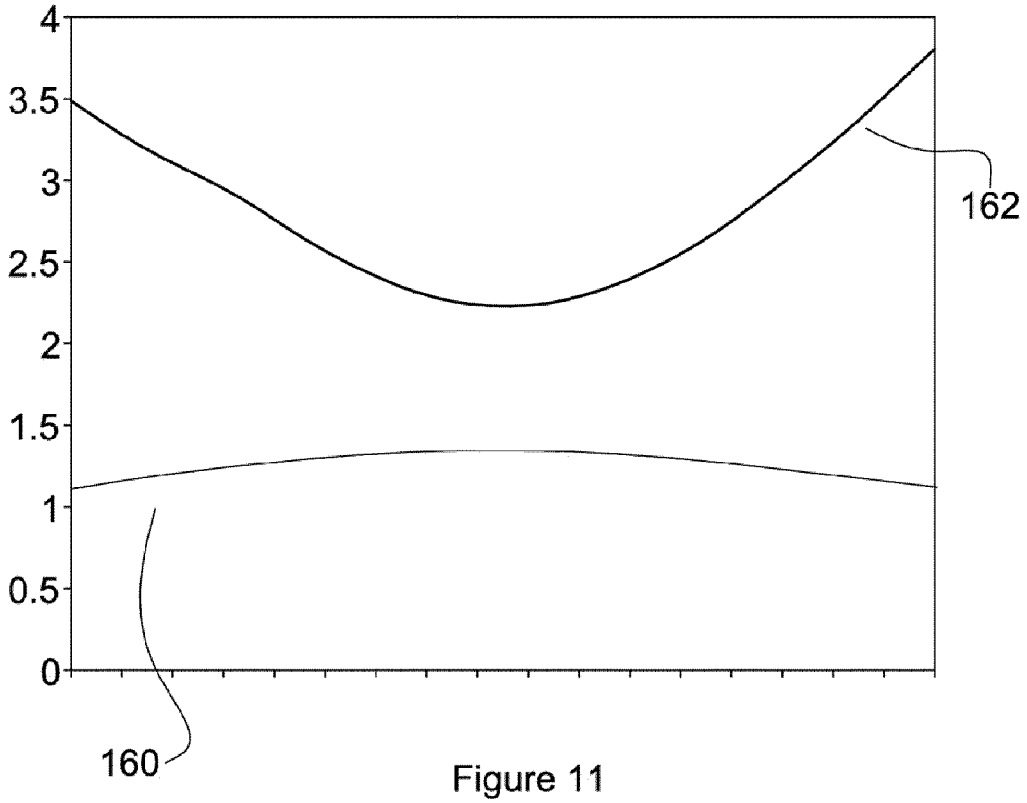
FIG. 11 shows two curves to represent the restoring provided by the edge suspension of FIG. 2 relative to displacement of the diaphragm (i) when corner portions are omitted from the edge suspension (lower curve); (ii) when corner portions as shown in FIG. 7 are present (upper curve).

In FIG. 11, the lower curve 160 represents the stiffness, or restoring force, of the blade springs 140 relative to displacement of the diaphragm 103 (relative to its rest position) for the edge suspension 104 of FIG. 2, modified so that the corner portions 150 have been omitted. The lower curve 160 is not desirable for a loudspeaker because the maximum restoring force is achieved when the diaphragm 103 is around the rest position. The upper curve 162 represents the stiffness, or restoring force, of the blade springs 140 relative to displacement of the diaphragm 103 for the edge suspension 104 of FIG. 2 where the corner portions 150 are present and provide a seal between the front and back sides of the diaphragm.

As shown by the upper curve 162 of FIG. 11, with the corner portions 150 of FIG. 7 are present in the edge suspension 104, the stiffness is lowest when the diaphragm 103 is around its rest position, as desired, and the curve is symmetric with respect to the y-axis, passing through the 0 mm displacement line. The upper curve 162 of FIG. 11 shows that as the diaphragm 103 is moved away from its rest position, in either the coil in or coil out direction, the blade springs 140 and corner portions 150 provide a restoring force to return the diaphragm to the resting position, the restoring force increasing as the displacement from the rest position increases.

The edge suspension 104 of FIG. 2, whose blade springs 140 are joined by corner portions 150 as shown in FIG. 7, can be manufactured from a single piece of material instead of requiring multiple pieces of material as is the case for the suspension elements described in U.S. Pat. Nos. 4,056,697 and 6,385,327.

Moreover, the edge suspension 104 of FIG. 2 can be used as the only suspension element in a loudspeaker, e.g. without the need for a spider.

Moreover, the edge suspension 104 of FIG. 2 can provide sealing between the front and back sides of the diaphragm 103. Thus leakage at the corners can be eliminated, unlike in U.S. Pat. Nos. 4,056,697 and 6,385,327. Note that by using the corner portions 150 to seal the corners between the edge springs 140, the edge suspension 104 of FIG. 2 allows an engineer to reduce the air gap so as to improve efficiency of the loudspeaker, because the edge suspension 104 greatly reduces the movement of the coil in the horizontal plane without the need for a spider.

The corner portions 150 could be used with an edge suspension that incorporates potentially any geometry of blade spring, e.g. such as those described in U.S. Pat. Nos. 4,056,697 and 6,385,327.

The bending stiffness of the blade springs 140 of the edge suspension 104 could be improved by:

1. Introducing materials which are rigid to the straight portions of the edge suspension 104, or
2. Introducing geometrical stiffness by manipulating the geometry of the straight portions of the edge suspension 104.

Examples of both techniques are given below with reference to FIGS. 12, 13 and 14. Where features correspond to those already described, corresponding reference numerals have been given and need not be described in further detail.

Figure 12:
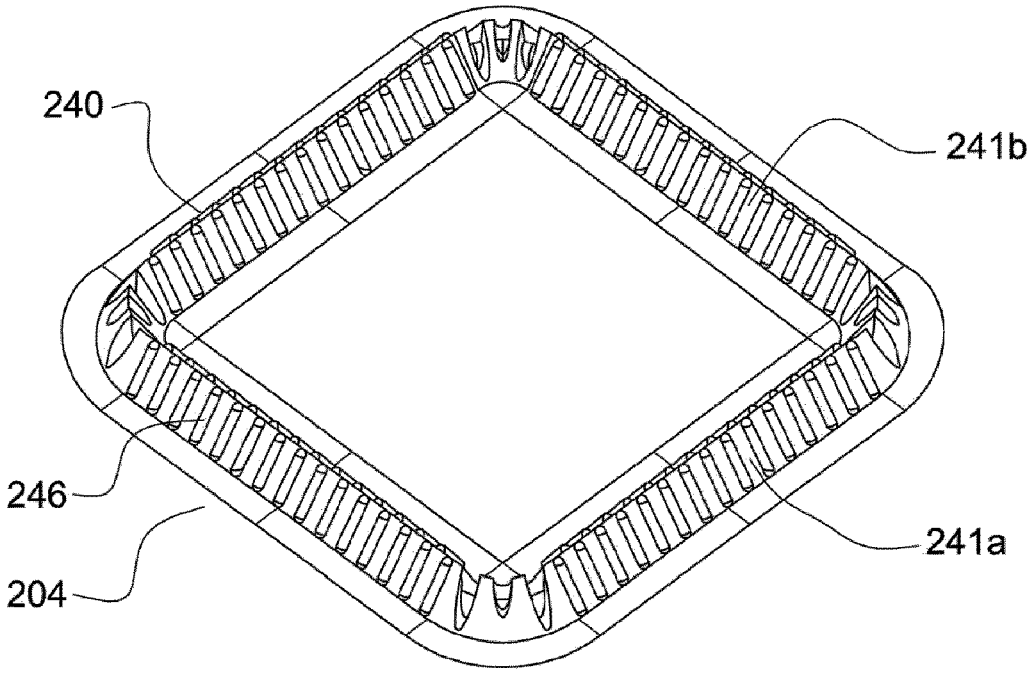
FIG. 12 shows an edge suspension with stiffening elements on the straight portions in the form of cylindrical ridges.

In FIG. 12, the edge suspension 204 is made of textile material (or could be made of another material such as copper, steel, foam, or paper) and its blade springs 240 include integrally formed stiffening elements which in this example are cylindrical ridges 246 integrally formed on the first and second surfaces 241*a*, 241*b* of the blade springs 240. The cylindrical ridges 246 increase the bending stiffness of the first and second surfaces 241*a*, 241*b* therefore increasing the frequency gap between the desired first resonant frequency and unwanted second resonant frequencies. In place of cylindrical ridges 246, it is also envisaged that the geometry could be manipulated by providing corrugations in the blade springs 240.

Figure 13:
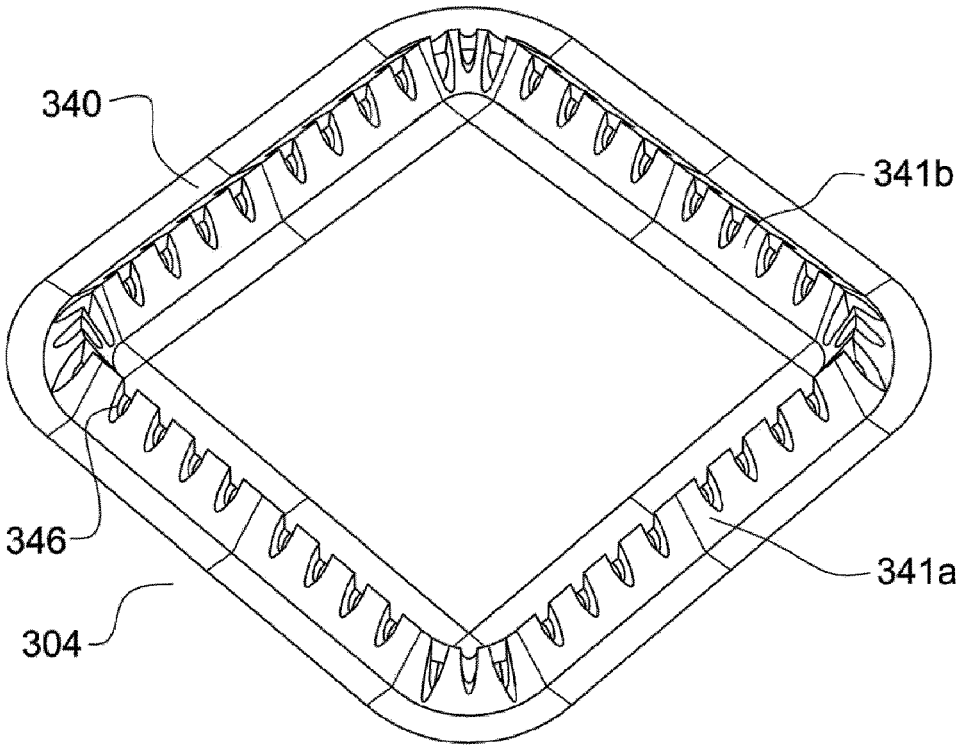
FIG. 13 shows an edge suspension with stiffening elements on the straight portions in the form of geometrical interruptions.

In FIG. 13, the edge suspension 304 is made of textile material (or could be made of another material such as copper, steel, foam, or paper) and its blade springs 340 include integrally formed stiffening elements which in this example are geometrical interruptions 346 having essentially the form described above in relation to the corner elements 150. Again, the geometrical interruptions 346 increase the bending stiffness of the first and second surfaces 341*a*, 341*b* therefore increasing the frequency gap between the desired first resonant frequency and unwanted second resonant frequencies.

Figure 14:
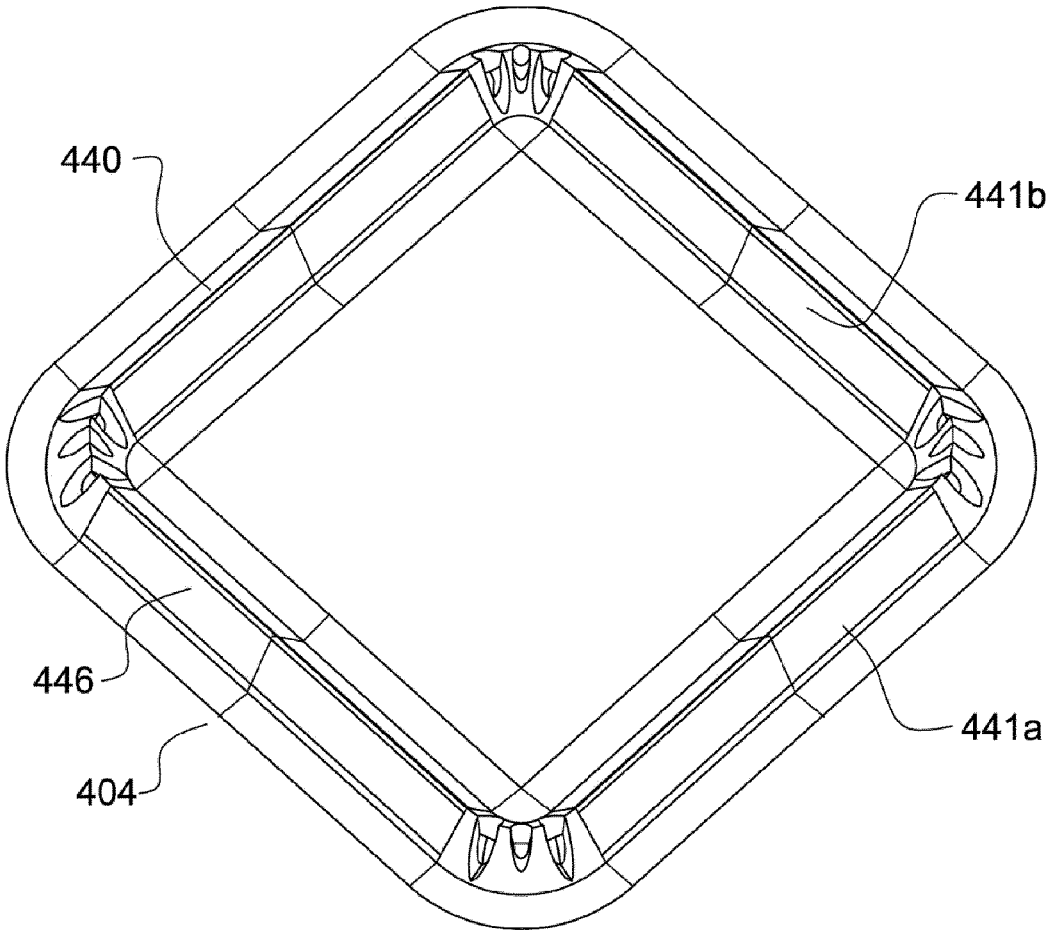
FIG. 14 shows an edge suspension with stiffening elements on the straight portions in the form of planar stiffening elements.

In FIG. 14, the edge suspension 404 is made of textile material (or could be made of another material such as copper, steel, foam, or paper) and its blade springs 440 include stiffening elements which in this example are planar stiffening elements 446 glued over the first and second surfaces 441*a*, 441*b* of the blade springs 440. The planar stiffening elements 446 could e.g. be made from paper or some other material such as copper, steel, or foam. The planar stiffening elements 446 help to improve the torsional stiffness of the underlying textile material. By increasing the torsional stiffness of the blade springs 440, a higher force is required to move the voice coil in the horizontal plane, thereby shifting unwanted resonant frequencies whose modes involve movement in the horizontal plane to higher frequencies. However, this torsional stiffness increase has a small influence over the 'vertical' stiffness (i.e. stiffness in the y-axis) of the suspension element. As a result, the observed shift in the desired resonant frequency is small.

Figure 15A:
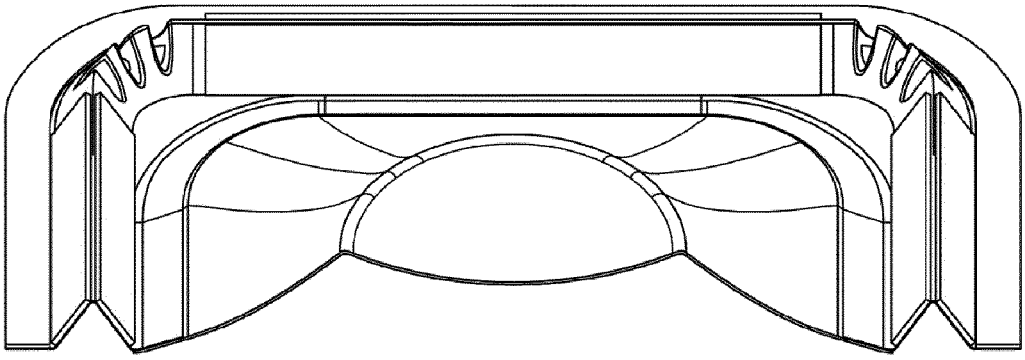
FIGS. 15(*a*) and (*b*) shows a suspension element and a diaphragm having an inverted cone portion.
Figure 15B:
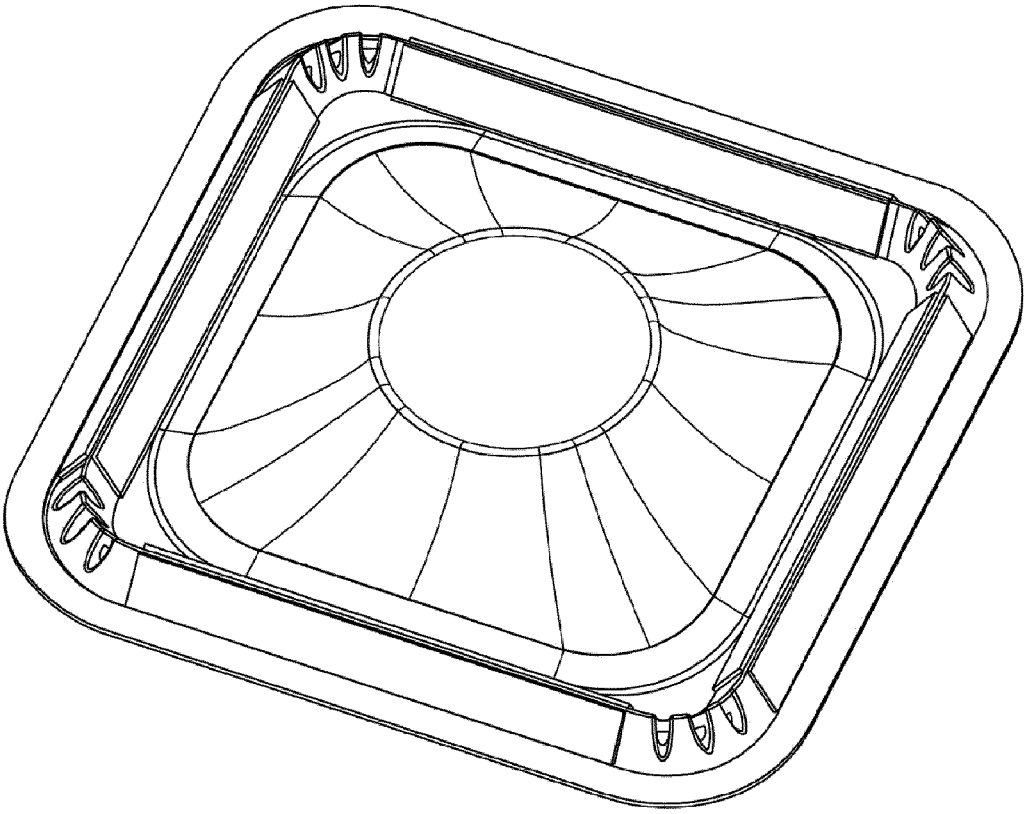
Figure 16:
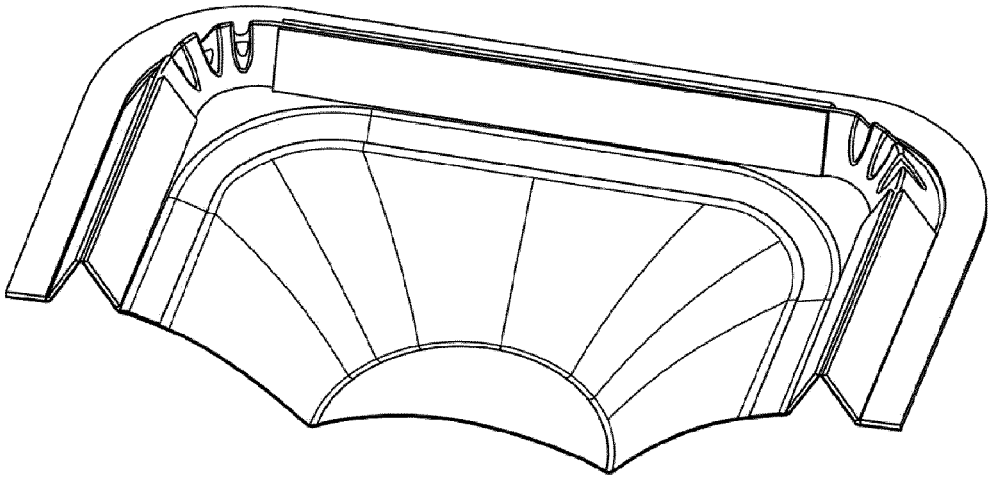
FIG. 16 shows a suspension element and a diaphragm having a cone portion.
Figure 17:
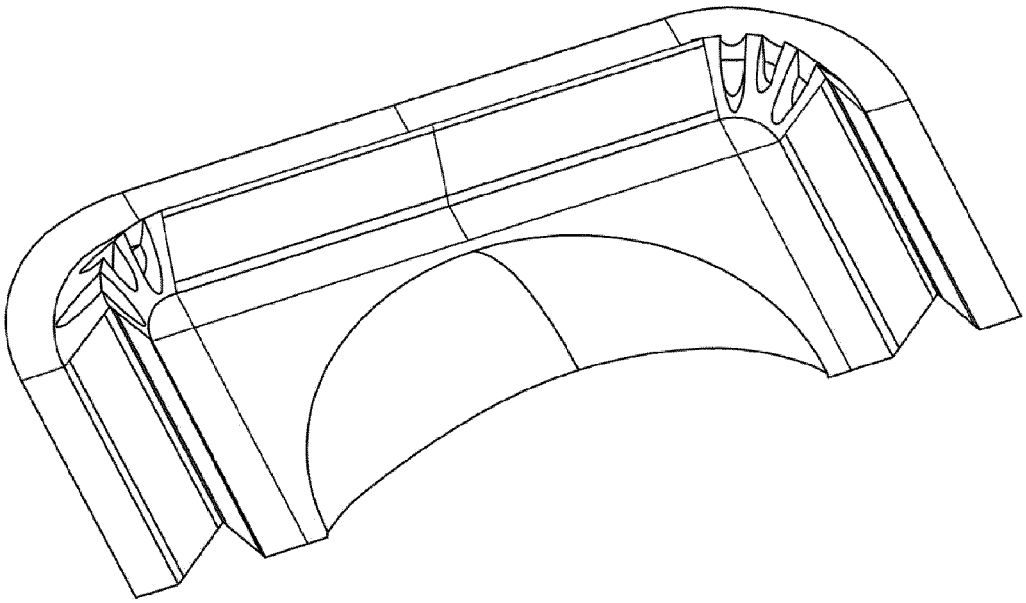
FIG. 17 shows a suspension element and a diaphragm including a dome.

The suspension element can be matched with different diaphragm geometries. For example, the diaphragm can be flat, include an inverted cone portion as shown in FIGS. 15(*a*) and (*b*), include a cone shaped portion as shown in FIG. 16 or include a dome as shown in FIG. 17, depending on the requirements of the design.

When used in this specification and claims, the terms "comprises" and "comprising", "including" and variations thereof mean that the specified features, steps or integers are included. The terms are not to be interpreted to exclude the possibility of other features, steps or integers being present.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The present inventors do not wish to be bound by any of these theoretical explanations.

All references referred to above are hereby incorporated by reference.

The invention claimed is:

1. A loudspeaker including a chassis, a drive unit and a diaphragm;

wherein the drive unit has a stationary part secured to the chassis and a translatable part secured to the diaphragm;

wherein an outer edge of the diaphragm is suspended from the chassis by an edge suspension;

wherein the edge suspension has a plurality of straight portions, each straight portion having a respective first surface and a respective second surface which meet along an edge to provide a spring which permits the diaphragm to be moved relative to the chassis by the drive unit;

wherein the edge suspension has at least one corner portion, wherein the/each corner portion joins two of the straight portions together and includes at least one geometrical interruption formed therein;

wherein the/each geometrical interruption formed in the/each corner portion includes a first corrugation which varies in height along a first path which extends circumferentially around the edge suspension, and a second corrugation formed within the first corrugation which varies in height along a second path which extends across the first path;

wherein each straight portion includes one or more stiffening elements;

wherein the one or more stiffening elements include one or more geometrical interruptions formed in each straight portion;

wherein the/each geometrical interruption formed in each straight portion includes a first corrugation which varies in height along a first path which extends circumferentially around the edge suspension, and a second corrugation formed within the first corrugation which varies in height along a second path which extends across the first path.

2. A loudspeaker according to claim 1, wherein the edge suspension is the only suspension element by which the diaphragm is suspended from the chassis.

3. A loudspeaker according to claim 1, wherein the one or more stiffening elements included in each straight portion further includes:

one or more ridges on the first surface and/or on the second surface of each straight portion; and/or one or more one planar sheets of material attached to the first surface and/or to the second surface of each straight portion.

4. A loudspeaker according to claim 1, wherein the/each corner portion has a first surface and a second surface which meet along a curved edge.

5. A loudspeaker according to claim 4, wherein the edge of the/each corner portion is a non-continuous edge including a plurality of edge segments with the edge segments being separated by the at least one geometrical interruption formed in the corner portion.

6. A loudspeaker according to claim 5, wherein the non-continuous edge of the/each corner portion includes a plurality of edge segments with the edge segments being separated by at least three geometrical interruptions formed in the corner portion.

7. A loudspeaker according to claim 6, wherein:

the non-continuous edge of the/each corner portion includes a plurality of edge segments separated by three geometrical interruptions formed in the corner portion, wherein the three geometrical interruptions include an inner geometrical interruption located between two outer geometrical interruptions;

for the/each corner portion, the inner geometrical interruption has a width and height that are smaller than the corresponding width and height of both of the outer geometrical interruptions.

8. A loudspeaker according to claim 1, wherein:

the first corrugation included in the/each geometrical interruption is a valley, wherein the valley is concave with respect to a front side of the edge suspension;

the second corrugation formed within each first corrugation is a hill, wherein the hill is convex with respect to the valley in which it is formed;

the first corrugation included in the/each geometrical interruption is a 'U' shaped valley;

the second corrugation formed within each first corrugation is an inverted 'U' shaped hill.

9. A loudspeaker according to claim 8, wherein the distance by which each hill extends into the mouth of the valley in which it is formed is less than half the depth of the valley in which it is formed.

10. A loudspeaker according to claim 1, wherein:

the/each corner portion provides a continuous seal between the diaphragm and the chassis;

the entire edge suspension provides a continuous seal between the diaphragm and the chassis.

11. A loudspeaker according to claim 1, wherein the/each corner portion is made from the same material as and integrally formed with the straight portions, wherein the material is a textile material, or a paper material.

12. A loudspeaker according to claim 1, wherein the edge suspension has a plurality of corner portions, wherein each corner portion joins two of the straight portions together and includes at least one geometrical interruption formed therein.

13. A loudspeaker according to claim 1, wherein:

the edge suspension comprises four straight portions and four corner portions to form a square/rectangular shape; and/or the diaphragm includes a dome or a cone shape portion.

14. A passive radiator that includes a chassis and a diaphragm;

wherein an outer edge of the diaphragm is suspended from the chassis by an edge suspension;

wherein the edge suspension has a plurality of straight portions, each straight portion having a respective first surface and a respective second surface which meet along an edge to provide a spring which permits the diaphragm to be moved relative to the chassis;

wherein the edge suspension has at least one corner portion, wherein the/each corner portion joins two of the straight portions together and includes at least one geometrical interruption formed therein;

wherein the/each geometrical interruption formed in the/each corner portion includes a first corrugation which varies in height along a first path which extends circumferentially around the edge suspension, and a second corrugation formed within the first corrugation which varies in height along a second path which extends across the first path;

wherein each straight portion includes one or more stiffening elements;

wherein the one or more stiffening elements include one or more geometrical interruptions formed in each straight portion;

wherein the/each geometrical interruption formed in each straight portion includes a first corrugation which varies in height along a first path which extends circumferentially around the edge suspension, and a second corrugation formed within the first corrugation which varies in height along a second path which extends across the first path.

15. An edge suspension for suspending an outer edge of a diaphragm from a chassis in a loudspeaker;

wherein the edge suspension has a plurality of straight portions, each straight portion having a respective first surface and a respective second surface which meet along an edge to provide a spring for permitting the diaphragm to be moved relative to the chassis by a drive unit of the loudspeaker;

wherein the edge suspension has at least one corner portion, wherein the/each corner portion joins two of the straight portions together and includes at least one geometrical interruption formed therein;

wherein the/each geometrical interruption formed in the/each corner portion includes a first corrugation which varies in height along a first path which extends circumferentially around the edge suspension, and a second corrugation formed within the first corrugation which varies in height along a second path which extends across the first path;

wherein each straight portion includes one or more stiffening elements;

wherein the one or more stiffening elements include one or more geometrical interruptions formed in each straight portion;

wherein the/each geometrical interruption formed in each straight portion includes a first corrugation which varies in height along a first path which extends circumferentially around the edge suspension, and a second corrugation formed within the first corrugation which varies in height along a second path which extends across the first path.

16. A loudspeaker according to claim 8, wherein the hill is contained entirely within the valley in which it is formed.

* * * * *